US005101642A

United States Patent [19]

Alexandrov

[11] Patent Number: 5,101,642

[45] Date of Patent: Apr. 7, 1992

[54] MEANS FOR COOLING BEVERAGE CONTAINERS IN A CARTON

[75] Inventor: Alex Alexandrov, Atlanta, Ga.

[73] Assignee: The Mead Corporation, Dayton, Ohio

[21] Appl. No.: 582,520

[22] Filed: Sep. 14, 1990

[51] Int. Cl.[5] ..... F25D 3/08; B65D 65/00

[52] U.S. Cl. ..... 62/371; 62/60; 206/427

[58] Field of Search ..... 62/457.1, 457.4, 457.5, 62/371, 372, 60; 206/427, 607, 620

[56] References Cited

U.S. PATENT DOCUMENTS

| | | | |
|---|---|---|---|
| 2,393,245 | 1/1946 | Hadsell | 62/1 |
| 2,514,651 | 7/1950 | Kornfeld et al. | 62/91.5 |
| 2,553,751 | 5/1951 | Courtade | 62/372 |
| 2,618,937 | 11/1952 | Francis | 62/91.5 |
| 2,648,954 | 8/1953 | Wheeler et al. | 62/371 |
| 3,401,535 | 9/1968 | Palmer | 62/457.5 |
| 3,565,320 | 2/1971 | Osborne et al. | 62/371 |
| 3,885,403 | 5/1975 | Spencer | 62/530 |
| 3,974,658 | 8/1976 | Starrett | 62/60 |
| 4,210,265 | 7/1980 | Steinlein | 206/427 |
| 4,266,407 | 5/1981 | Gibson | 62/371 |
| 4,292,817 | 10/1981 | Loucks | 62/457 |
| 4,344,300 | 8/1982 | Taylor | 62/457 |
| 4,344,301 | 8/1982 | Taylor | 62/457 |
| 4,344,303 | 8/1982 | Kelly, Jr. | 62/530 |
| 4,399,668 | 8/1983 | Williamson | 62/457 |
| 4,441,336 | 4/1984 | Cannon | 62/371 |
| 4,446,705 | 5/1984 | Loucks | 62/372 |
| 4,470,264 | 9/1984 | Morris | 62/60 |
| 4,554,798 | 11/1985 | D'Amour et al. | 62/457 |
| 4,607,502 | 8/1986 | Tomac | 62/294 |
| 4,628,705 | 12/1986 | Nave | 62/457 |
| 4,721,237 | 1/1988 | Leslie | 62/371 X |
| 4,747,274 | 5/1988 | Duemmig-Zitzmann | 62/371 |
| 4,974,731 | 12/1990 | Wood | 206/607 |

*Primary Examiner*—Albert J. Makay
*Assistant Examiner*—William C. Doerrler
*Attorney, Agent, or Firm*—Troutman, Sanders, Lockerman & Ashmore

[57] ABSTRACT

A beverage container cooling device comprising a carton for containment of a plurality of beverage containers, said carton having a reclosable opening, a plurality of separately removable individual refrigeration elements, each said refrigeration element being substantially filled with a refrigerant having a freezing point of 40° F. or less, each said refrigeration element being adapted to substantially fill any existing space between said beverage containers positioned in a non-aligned configuration within said carton, each said refrigeration element having a plurality of heat conducting surfaces dimensioned for surface contact with the outer surfaces of a plurality of said beverage containers such that heat transfer between said refrigeration elements and said beverage containers occurs primarily by conduction.

50 Claims, 8 Drawing Sheets

MEANS FOR COOLING BEVERAGE CONTAINERS IN A CARTON

BACKGROUND AND SUMMARY OF THE INVENTION

The present invention relates to beverage container cooling devices. More particularly, this invention relates to removable refrigeration elements for cooling beverage container within a beverage carton.

Carbonated sodas, fruit juices, beer, etc. are commonly stored within individual beverage containers, such as bottles or cans, for distribution in packs of six, twelve or more. These packs of beverage containers may be formed by a carton formed of paperboard or cardboard. The beverage carton provides an easily transportable and disposable storage device for the beverage containers.

The beverage containers housed within the beverage carton can be refrigerated by a retailer or consumer. However, the beverage containers within the carton generally do not remain cool for more than a short time after they are no longer refrigerated. Consequently, specially adapted insulated containers, sometimes referred to as coolers, are often employed to maintain the beverage containers at a reduced temperature.

U.S. Pat. No. 3,974,658 to Starrett discloses a portable refrigeration unit for maintaining cans or bottles containing beverages at a predetermined refrigerated temperature for a desired period of time. Individual cans or bottles are placed within an outer insulating case or container having an internal refrigeration cartridge as its bottom surface. The refrigeration cartridge has a plurality of curved surfaces adapted to contact the end or side surfaces of the beverage cans or bottles, thereby cooling the beverage cans or bottles by conduction.

U. S. Pat. No. 2,648,954 to Wheeler et al. also discloses a refrigerated carton for maintaining beverage containers at a reduced temperature. Removable cardboard partitions for holding refrigeration containers are placed within the carton. The refrigeration containers are elongated, rectangular cylinders that are placed in close proximity to the beverage containers, thereby cooling by convection.

The prior art devices suffer from several drawbacks. The prior art devices do not allow incorporation of refrigeration elements into a standard paperboard beverage carton. Moreover, the prior art devices fail to effectively maximize the contact areas between the beverage containers and refrigeration elements, which enhances the refrigerating function provided by such refrigeration elements. These and other drawbacks of the prior art are overcome by the present invention.

It is, therefore, an object of the present invention to provide an improved means for cooling beverage containers within a carton.

It is another object of the present invention to provide an improved means for cooling beverage containers within a carton that employs reusable and removable refrigeration elements.

It is another object of the present invention to provide an improved means for cooling beverage containers within a carton that can be employed with a standard beverage carton.

It is a further object of the present invention to provide an improved means for cooling beverage containers within a carton that utilizes existing spaces between beverage containers within the beverage carton for placement of refrigeration elements.

It is yet another object of the present invention to provide an improved means for cooling beverage containers within a carton that maximizes the beverage container surface area that is in contact with the refrigeration elements.

It is still a further object of the present invention to provide an improved means for cooling beverage containers within a carton that maintains the beverage containers at a reduced temperature for substantial time periods of at least four hours or more.

It is still a further object of the present invention to provide an improved means for cooling beverage containers within a carton that is inexpensive and convenient to use.

These and other objects and advantages are achieved by the present invention, which, in one preferred embodiment, comprises a plurality of reusable, removable refrigeration elements that are inserted into a standard paperboard beverage carton housing a plurality of beverage containers. The refrigeration elements are adapted to fit into the existing spaces formed between beverage containers within the carton. The refrigeration elements are further adapted to form a contacting relationship with the adjacent beverage containers, thereby maintaining the beverage containers at reduced temperatures through conduction.

DETAILED DESCRIPTION OF PREFERRED EMBODIMENTS

Figure 1:
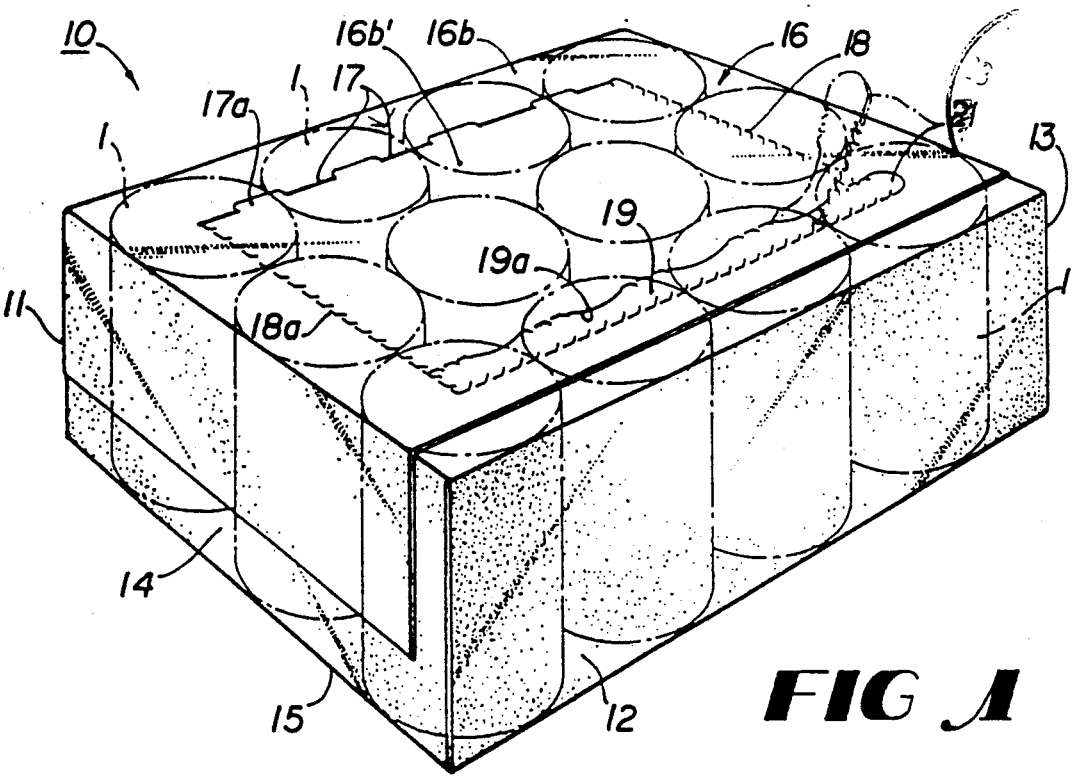
FIG. 1 is a perspective view of a preferred embodiment of the present invention.
Figure 2:
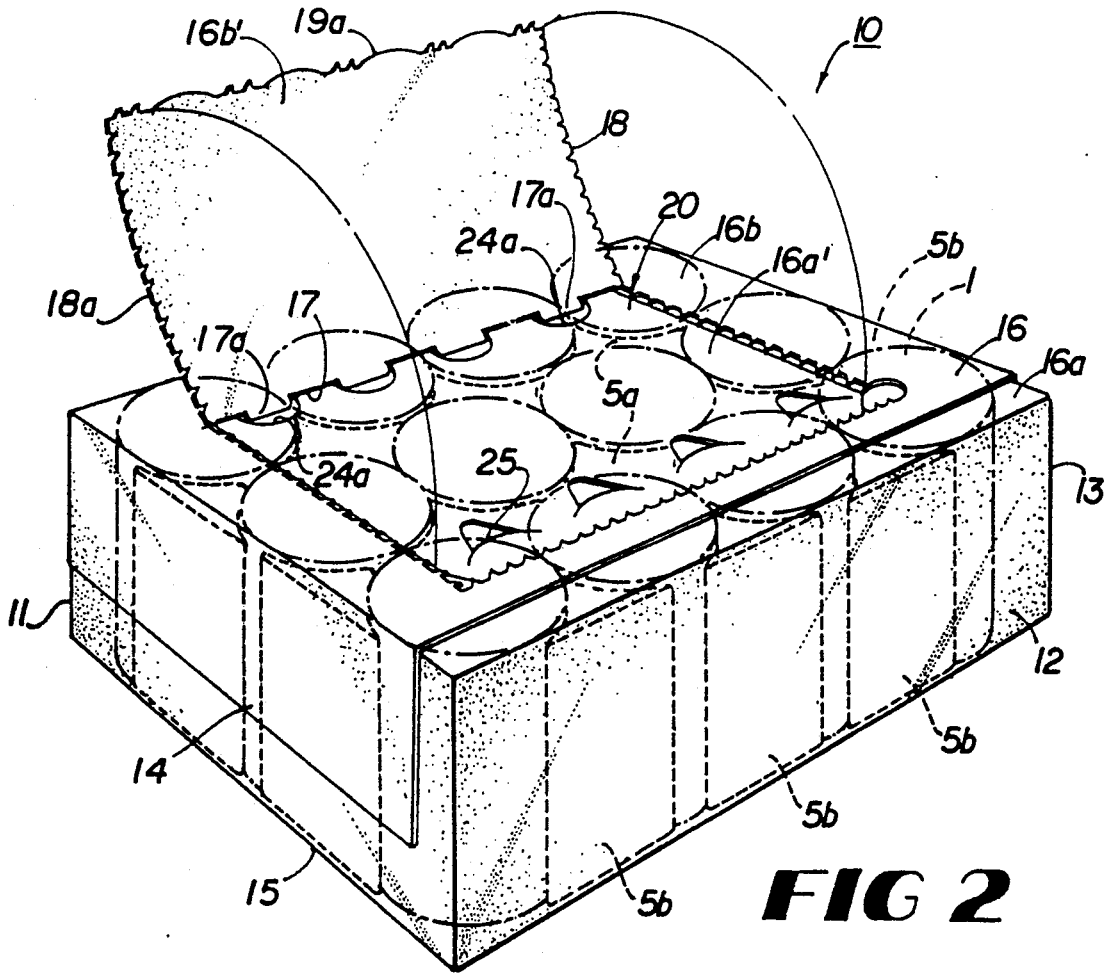
FIG. 2 is a perspective view similar to FIG. 1 with the opening tear strip separated from the beverage carton and a first panel separated from its perforations and placed in a folded position

Referring to FIGS. 1–5, a reclosable beverage carton 10 is shown in which a plurality of beverage containers 1 and refrigeration elements 5*a* and 5*b* are contained. Carton 10 is formed with top wall 11, bottom wall 12, end walls 13 and 14, and side walls 15 and 16. Top wall includes a slot handle 2, of the type described in U.S. Pat. No. 4,558,816, to facilitate carrying carton 10. Through a slot handle 9 is shown, other known handle structures and configurations for carrying carton 10 may also be employed advantageously.

Side wall 15 includes an opening 15*a* through which beverage containers 1 are removed by the user in normal use. Side wall 16 includes an inner layer 16*a* and an outer layer 16*b*. A reclosable opening 20 in side wall 16, struck from inner layer 16*a* and outer layer 16*b*′ is forced by inner panel 16*a*′ and outer panel 16*b*′. Outer panel 16*b*′ is defined by fold line 17, tear lines 18 and 18*a* and one edge 19*a* of tear strip 19 having a pull tab 21 secured to one end of tear strip 19. Outer panel 16*b*′ includes a plurality of heel projections 17*a* along fold line 17. Inner panel 16*a*′ is defined by fold line 22, cut scoring lines 23 and 23*a* and edge portion 24. Edge portion 24 of inner panel 16*a*′ includes a plurality of apertures 24*a* for engagement with the heel projections 17*a* of outer panel 16*b*′ when inner panel 16*a*′ is placed in a closed position. Inner panel 16*a*′ further includes a plurality of arc-like tabbed openings 25 for engagement with edge portion 19*a* of outer panel 16*a* when outer panel 16*a*′ is placed in a closed position. Inner panel 16*a*′ is preferably dimensioned such that panels 16*a*′ and 16*b*′ have substantially the same widths, while inner panel 16*a*′ has a somewhat greater length than that of outer panel 16*b*′, such that edge portion 24 of inner panel 16*a*′ extends underneath fold line 17 of outer panel 16*b*′ into flat face contacting relation with at least a portion of the inner surface of outer layer 16*b* when inner panel 16*a*′ is placed in a closed position.

To open the carton 10, pull tab 21 is engaged to remove tear strip 19. Outer panel 16*b*′ is engaged at edge 19*a* and elevated to sever the outer panel 16*b*′ along lines 18 and 18*a* and fold the outer panel 16*b*′ along fold line 17 into the position shown, for example, in FIG. 2. Inner panel 16*a*′ is engaged using opening 25 and elevated to fold the inner panel 16*a*′ along fold line 22 into the position shown, for example, in FIG. 3. Beverage containers 1 and refrigeration elements 5 can be removed from and reinserted into carton 10 through the reclosable opening 20 formed by panels 16*a*′ and 16*b*′.

Figure 3:
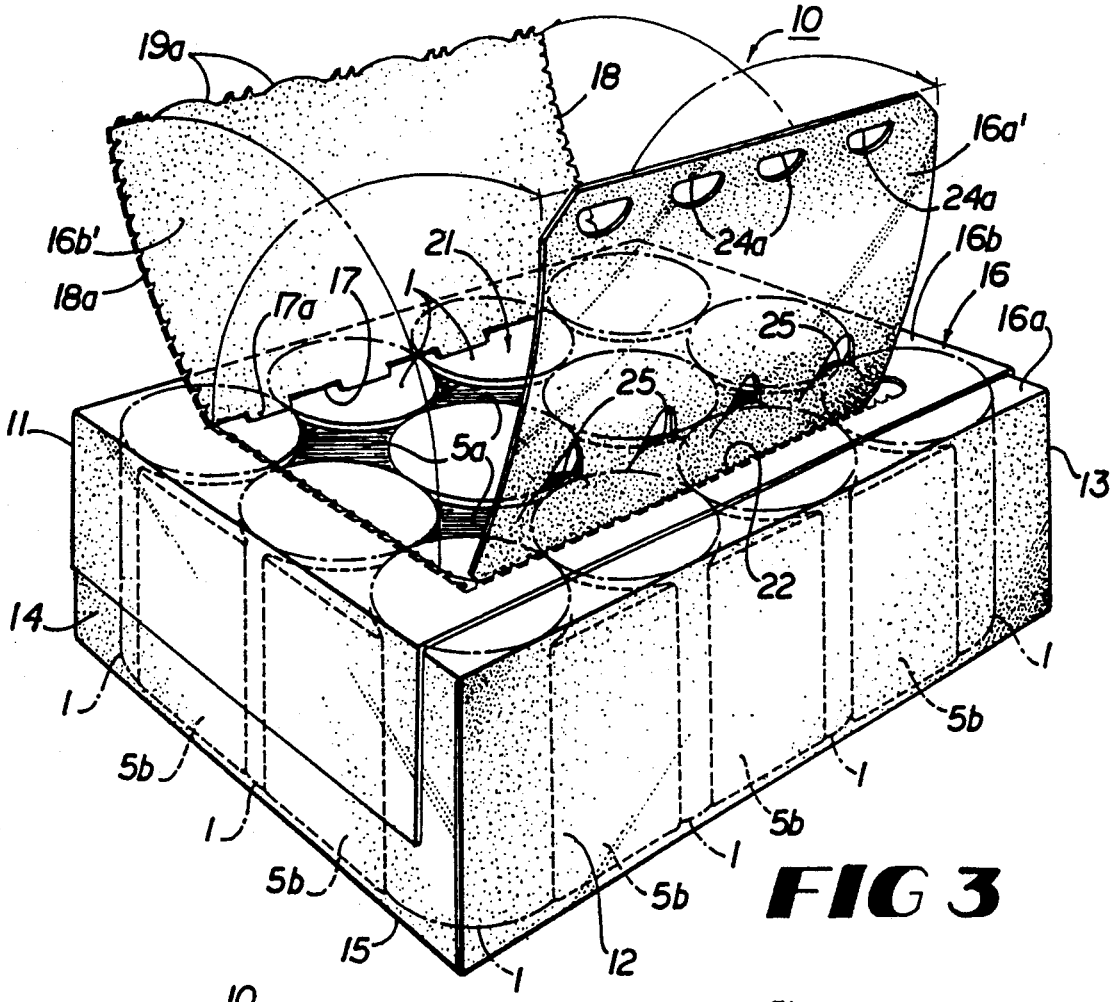
FIG. 3 is a perspective view similar to FIG. 2 with a second panel separated from its perforations and folded up to provide access to the beverage containers within the beverage carton.
Figure 4:
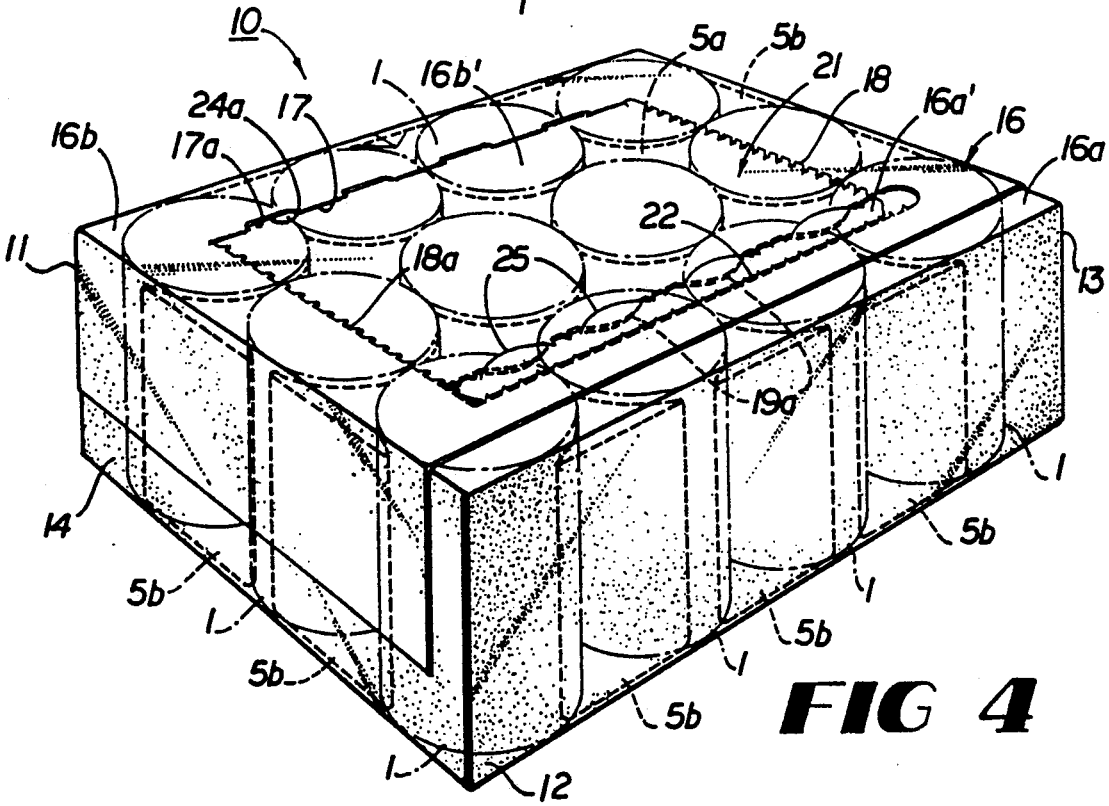
FIG. 4 is a perspective view of the carton of FIGS. 1-3 showing the reclosable interlock between the first and second panels.
Figure 5:
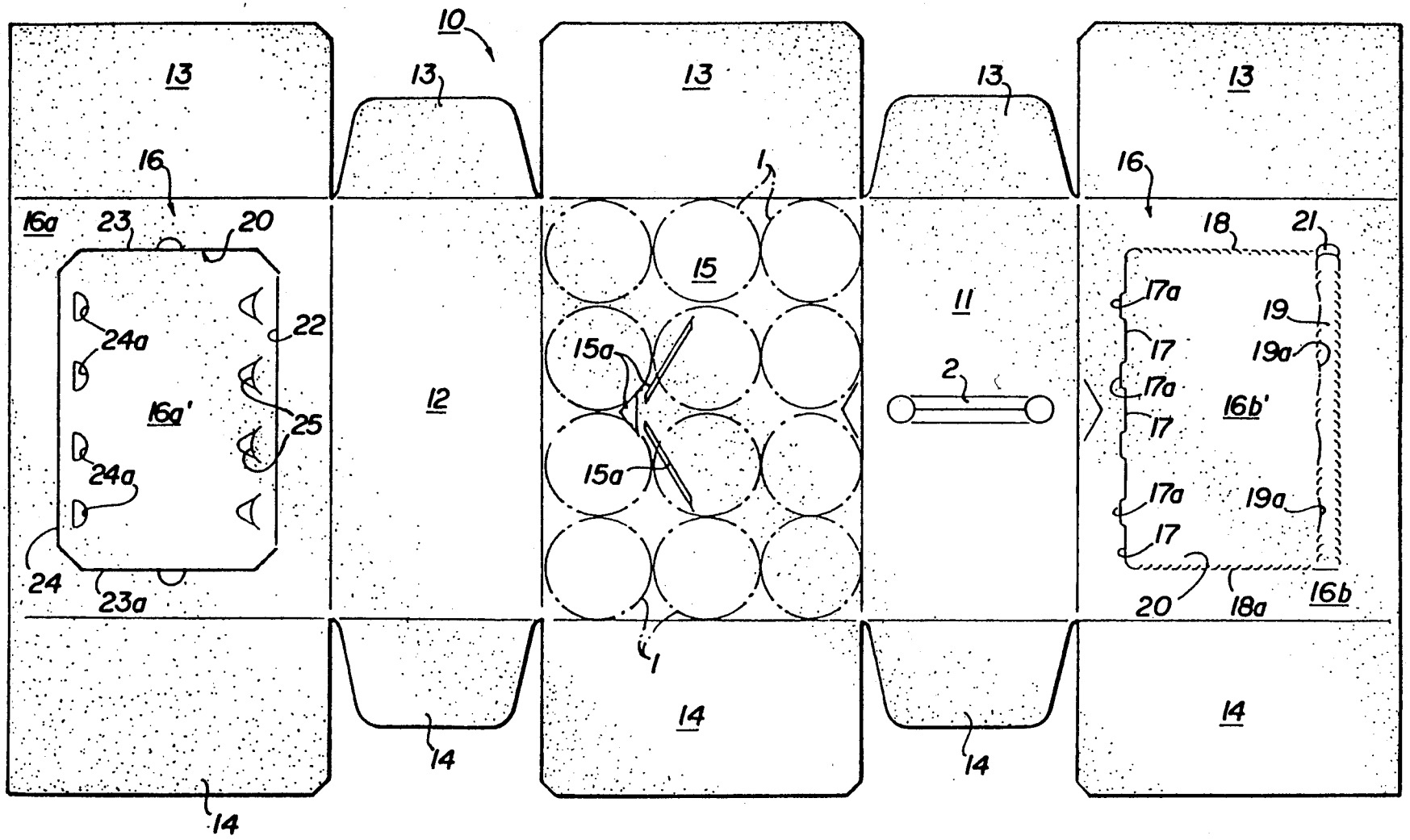
FIG. 5 is a plan view of the pattern or blank of the beverage carton in the flat, with associated perforation, cut outs and fold lines to form the beverage carton.
Figure 6:
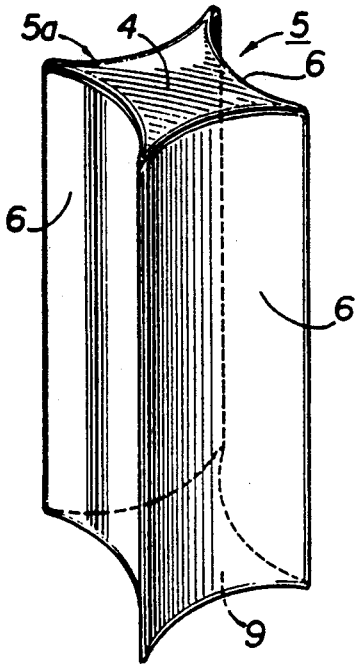
FIG. 6 is a perspective view of a refrigeration element of the present invention.
Figure 7:
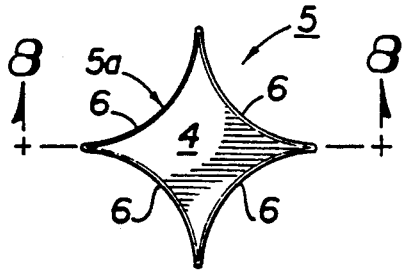
FIG. 7 is a top plan view of the refrigeration element of FIG. 6.
Figure 8:
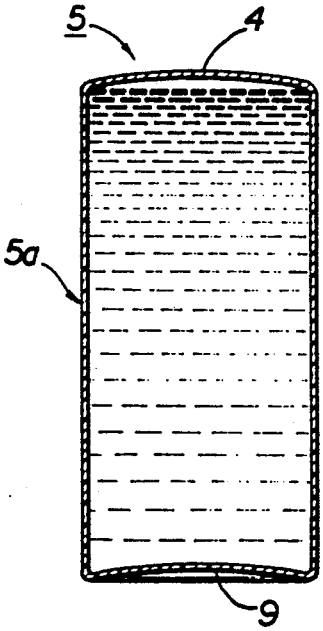
FIG. 8 is a section view taken along lines 8—8 in FIG. 7.
Figure 9:
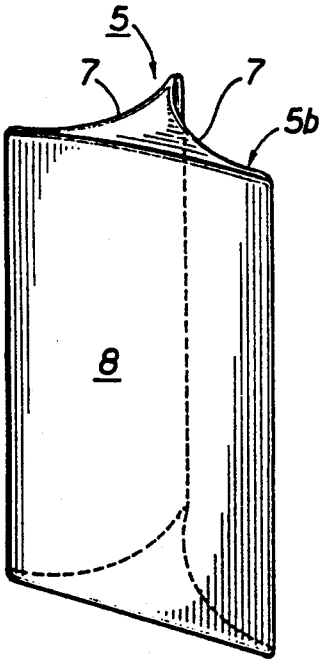
FIG. 9 is a perspective view of another embodiment of a refrigeration element of the present invention.
Figure 10:
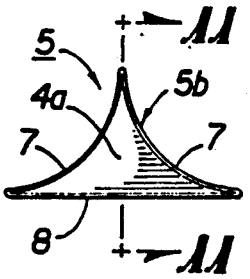
FIG. 10 is a top plan view of the refrigeration element of FIG. 9.

To reclose carton 10, inner panel 16*a*′ is repositioned from the position shown in FIG. 3 such that edge portion 24 is tucked under fold line 17 of panel 16*b*′ and into flat face contacting relation with at least a portion of the inner surface of outer layer 16*b* extending between fold line 17 and top wall 11. Heel projections 17*a* of outer panel 16*a*′ engage apertures 24*a* of inner panel 16*b*′. Outer panel 16*b*′ is repositioned from the position shown in FIG. 2 such that edge portion 19*a* engages arc-like tabbed openings 25 of inner panel 16*b*, as shown in FIG. 4. When inner panel 16*b*′ and outer panel 16*a*′ are placed in the position shown in FIG. 4, the engagement of heel projections 17*a* with apertures 24*a* and edge portion 17*a* with openings 25 locks panels 16*a*′ and 16*b*′ in a closed or reclosed position.

Referring to FIGS. 6–11A, refrigeration elements 5*a* and 5*b* are shown. Each refrigeration element is formed of a rigid, heat conductive metallic or nonmetallic material, such as, for example, high density polyethylene, that is operative in the range of temperatures for which the refrigeration elements 5 are intended for use. Each refrigeration element contains a refrigerant having a lower freezing point than water. A preferred refrigerant is a water and salt compound in a gum base that is commercially available from Polyfoam Packers Corp. of Wheeling, Ill. under the trademark UOTEK ®. Other suitable refrigerants, however, are also known to those of ordinary skill in the art and can be employed advantageously with the present invention.

Each refrigeration element 5 is adapted to fit into the existing spaces between beverage containers 1 within carton 10. The configuration of each refrigeration element 5 can be altered to accommodate different types of beverage containers 1, such as cans, bottles and the like. In the embodiment shown, each refrigeration element 5*a* has four concave sides 6 that form a contacting, heat conducting relationship with the sides of up to four beverage containers 1. Refrigeration elements 5*a* are intended for placement between the centermost beverage containers 1 within carton 10. Each refrigeration element 5*b* has two concave sides 7 that form a contacting, heat conducting relationship with the sides of up to two beverage containers and a third planar side 8 that is in contacting relation with the inner surface of the top, bottom and end walls 11–14 of carton 10. Refrigeration elements 5*b* are intended for placement between the outermost beverage containers 1 and adjacent walls 11–14 of carton 1.

Each refrigeration element 5 is further adapted to have substantially the same height as the beverage containers 1, thereby maximizing the surface area of each beverage container 1 in contacting, heat conducting relation with refrigeration elements 5. In the embodiment shown, each refrigeration element 5 contacts up to about 22% of the side surface of each beverage container 1 that is adjacent to and in contact with the refrigeration element.

Preferably, the bottom surface 9 of each refrigeration element 5*a* is concave in shape. This concave bottom surface 9 provides more stability when the refrigeration element 5*a* is standing up, such as when it is stored or placed within a refrigeration device for freezing the refrigerant. This concave bottom surface 9 also allows the refrigerant within each refrigeration element 5*a* to expand during refrigeration without causing deformation of the concave sides 6 of the refrigeration element 5*a*. The concave bottom surface 9 of each refrigeration element 5*a* also provides an air gap between the bottom wall 14 of carton 10 and the refrigeration element 5*a*, which serves as a thermal insulator and lessens the transfer of heat between the refrigeration elements 5*a* and ambient air surrounding carton 10. The top surface 4 of each refrigeration element 5*a* is preferably convex in shape. The convex top allows a small air gap to be maintained within the refrigeration element 5*a* which can be compressed when the refrigerant expands during freezing. The air gap should be kept to a minimum, however, to maximize the amount of refrigerant that is contained within each refrigeration element 5*a*. The differing top surface 4 and bottom surface 9 configurations of refrigeration elements 5*a* also facilitates proper orientation of the refrigeration elements 5a within carton 10 by the user.

The top surface 4 of each refrigeration element 5a may further be adapted to allow connection of an advertising billboard to carton 10. A button or protrusion, for example, can be formed in top surface 4 of each refrigeration element 5a, to which an advertising billboard can be attached by snap or force fitting the refrigeration element buttons into perforations in the billboard.

With respect to refrigeration elements 5b, the top surfaces 4a and bottom surfaces 9a are convex and concave, respectively, as described above in connection with refrigeration elements 5a.

In typical usage, refrigeration elements 5 are placed within a refrigerating device until the liquid refrigerant contained within the refrigeration elements 5 is frozen. Reclosable opening 20 of carton 10 is placed in an open position and the refrigeration elements 5 are then placed between beverage containers 1 within carton 10. In order to place refrigeration elements 5b along the inner surfaces of walls 11-14 of carton 10, the user may first remove several of the beverage containers 1 to allow access to the walls 11-14 through opening 20 of carton 10. Alternatively, reclosable opening 20 may be enlarged such that when panels 16a' and 16b' are placed in an open position, refrigeration elements 5b can be inserted between beverage containers 1 along the inner surfaces of walls 11-14 of carton 10 without first removing any beverage containers 1. Refrigeration elements 5a may be inserted between the centermost beverage containers 1 through opening 20. Panels 16a' and 16b' may then be returned to a closed position for transporting carton 10.

When removing individual beverage containers 1 from carton 10, the user will open panel 15a in side wall 15 to access the beverage containers 1. As the beverage containers 1 are removed, the beverage containers 1 can be rearranged to take advantage of the greater cooling effect provided by the refrigeration element configuration in the centermost portion of carton 10. Because each beverage container 1 in the centermost portion of carton 10 is adjacent to up to four refrigeration elements 5a, as opposed to up to two refrigeration elements 5b along the side walls of carton 10, beverage containers 1 in the centermost portion remain at a reduced temperature for longer periods of time. Therefore, as space in the center of carton 10 becomes available due to the removal of beverage containers 1, the remaining beverage containers 1 can be moved inwardly to maximize the cooling function provided by refrigeration elements 5a.

Figure 12:
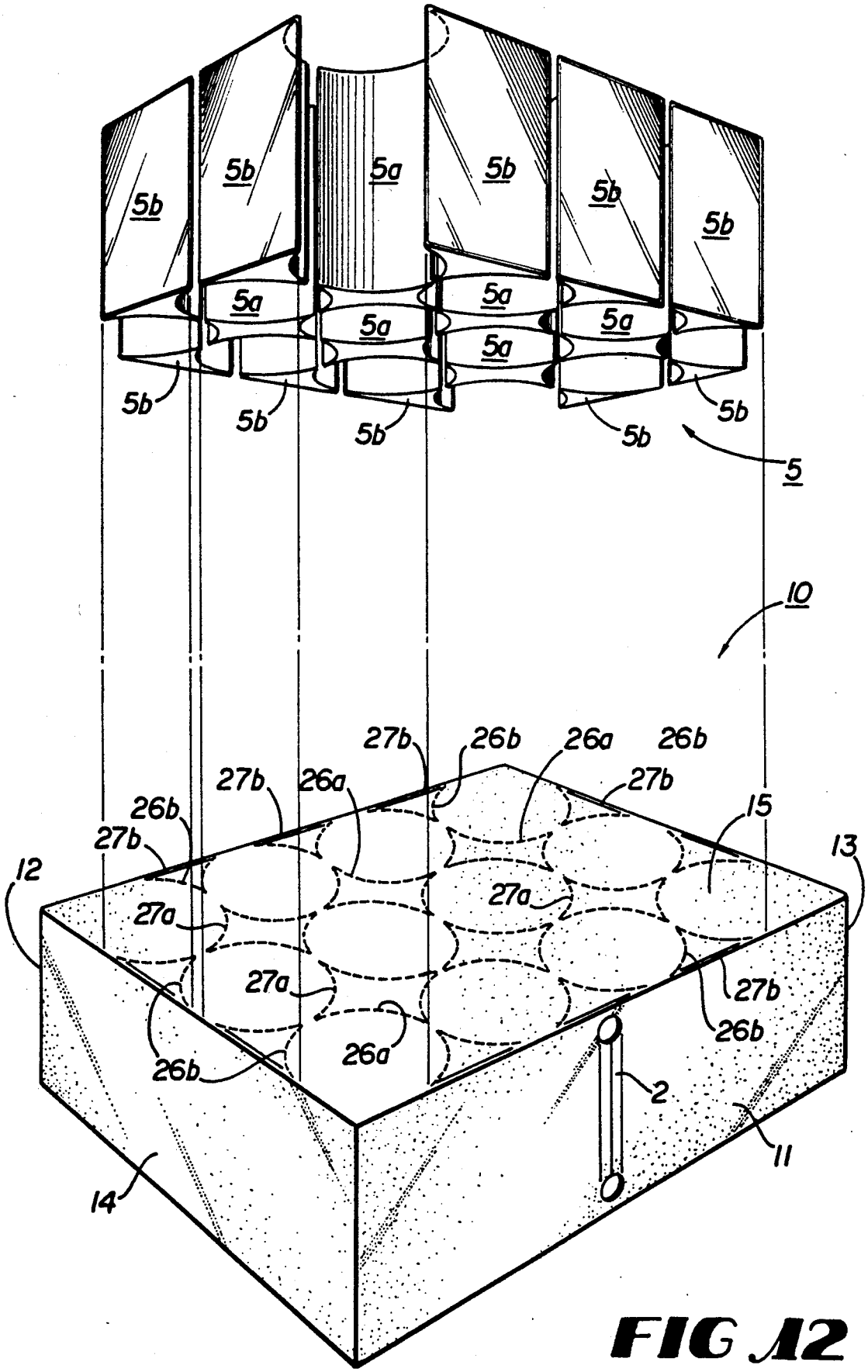
FIG. 12 is an exploded perspective view of an alternate embodiment of the present invention.

In another embodiment of reclosable carton 10, as shown in FIG. 12, side wall 16, including inner layer 16a and outer layer 16b, may have a plurality of perforations 26a and 26b through which refrigeration elements 5 are inserted into carton 10. Perforations 26a and 26b are adapted to closely fit the outer dimensions of refrigeration elements 5. For example, perforations 26a for refrigeration elements 5a may be formed to match the four concave sides 6 of refrigeration elements 5a, or may be formed in the shape of a square with the corners of the square corresponding to the four outermost points of refrigeration elements 5a. Likewise, perforations 26b for refrigeration elements 5b may be formed to match the concave and planar sides of refrigeration elements 5b or may be formed in the shape of a triangle. Preferably, one side of perforations 26a and 26b is defined by a fold line 27a and 27b, respectively, such that the perforated portions of side wall 16 remain attached to carton 10 after insertion of refrigeration elements 5, thereby eliminating the need for the user to dispose of the perforated paperboard pieces.

Figure 11:
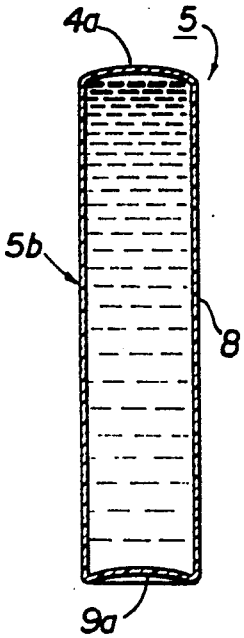
FIG. 11 is a section view taken along lines 11—11 in FIG. 10.
Figure 11A:
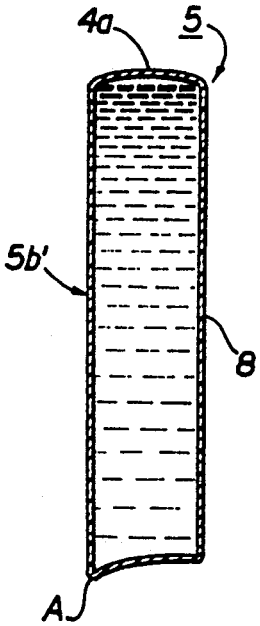
FIG. 11A is a section view of another embodiment of the refrigeration element of FIG. 10.

While in the embodiment shown in FIG. 12, perforations 26a and 26b exist for refrigeration elements 5a and 5b, perforations 26b may be provided alternatively for only refrigeration elements 5b. In this instance, reclosable opening 20 may be dimensioned such that only the centermost beverage containers 1 are accessible through opening 20 for insertion of refrigeration elements 5a. Refrigeration elements 5b may further be adapted such that bottom surface 9a is slightly angled, from 1°-7°, to form a point A, as shown in FIG. 11A. Forming a point in the bottom surface 9a of refrigeration elements 5b facilitates punching through perforations 26b in carton 10.

Figure 13:
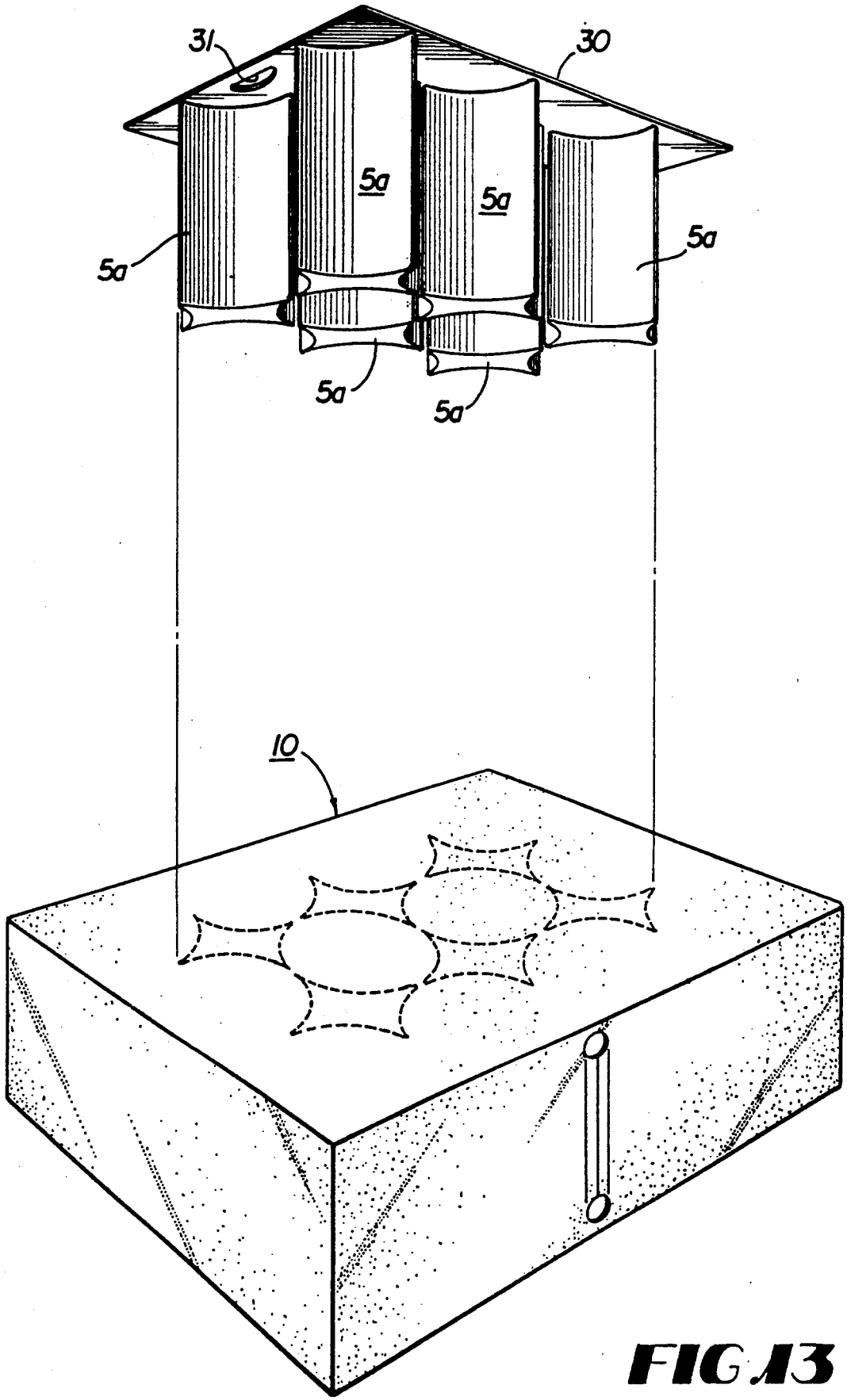
FIG. 13 is an exploded perspective view of a further embodiment of the present invention.

Referring now to FIG. 13, a paperboard panel-refrigeration element combination is shown in which refrigeration elements 5a are attached to a paperboard panel 30. Panel 30 substantially matches the dimensions of reclosable opening 20 in carton 10. Panel 30 may include apertures 31 to facilitate handling the panel-refrigeration element combination when inserting the panel-refrigeration element combination into carton 10 or removing it therefrom. Refrigeration elements 5a may be affixed to panel 30 by any suitable method, for example, by use of an adhesive, that results in a substantially permanent connection between the refrigeration elements 5a and panel 30. Other suitable attachment methods include forming buttons or protrusions in the top surfaces 4 of refrigeration elements 5a for insertion through appropriately spaced perforations in panel 30 to form a snap or force fitted connection between refrigeration elements 5a and panel 30. Refrigeration elements 5a are positioned on panel 30 to correspond to the existing spaces between beverage containers 5 within carton 10. The panel-refrigeration element combination prevents the individual refrigeration elements 5a from moving within carton 10 as beverage containers 5 are removed from carton 10 by the user. In addition, the panel-refrigeration element combination allows beverage containers 5 to be maintained within the centermost area of carton 10, wherein each beverage container 5 is surrounded by refrigeration elements 5a and thereby exposed to the maximum cooling effect of the refrigeration elements 5a.

Figure 14:
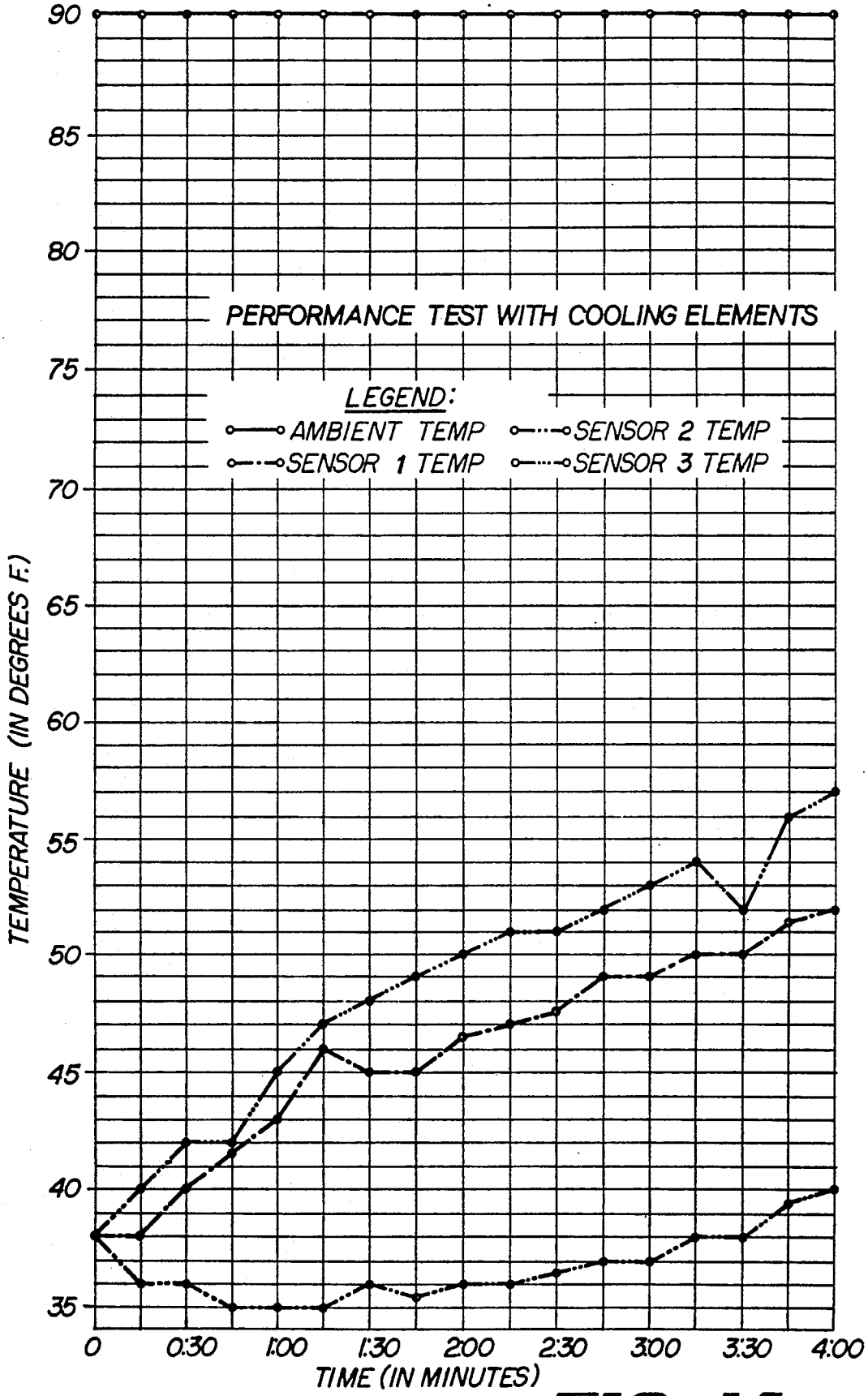
FIG. 14 is a graph illustrating the results of a performance test of the embodiment of the present invention shown in FIGS. 1-3.
Figure 15:
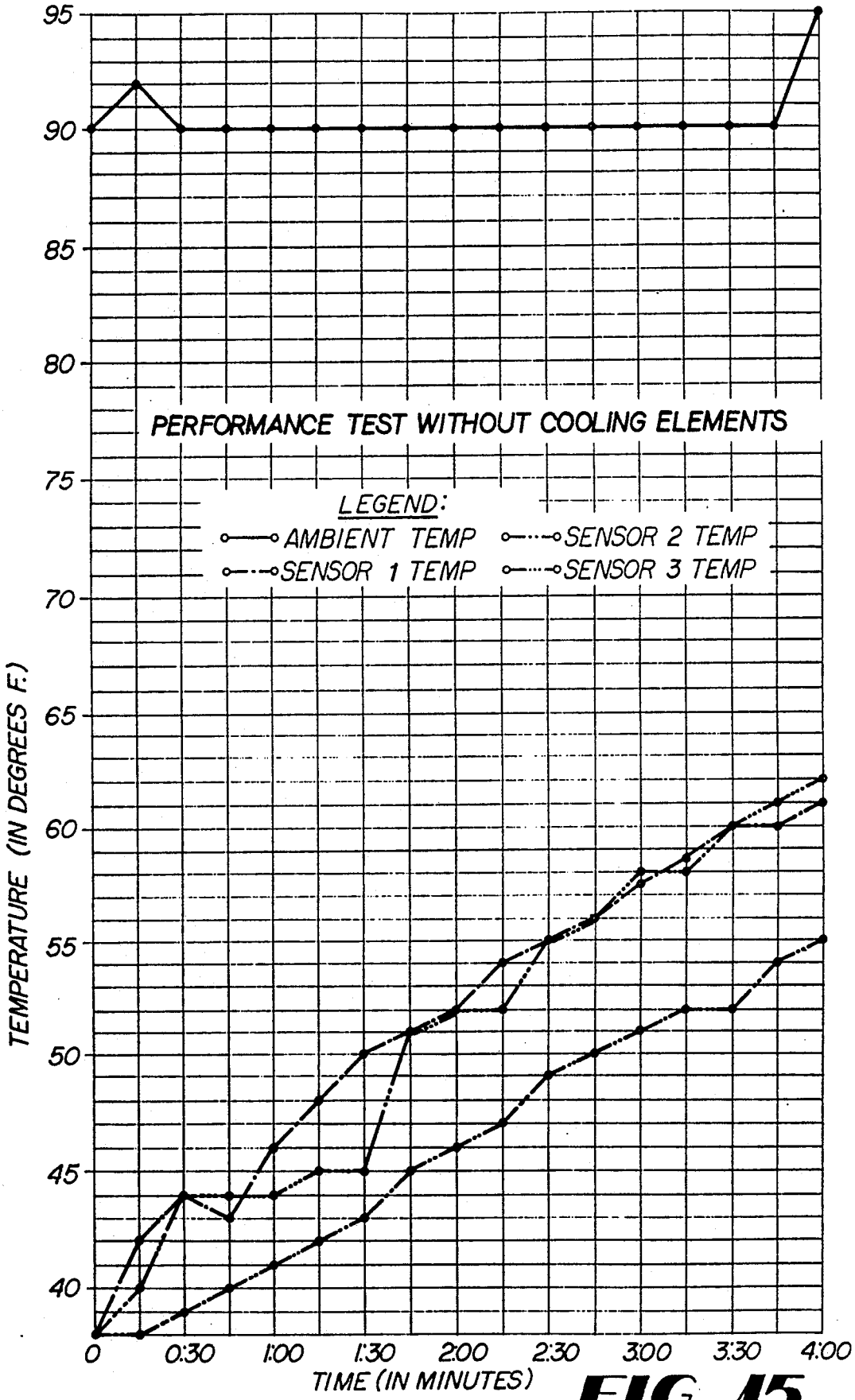
FIG. 15 is a graph illustrating the results of a comparison test of a beverage carton without the refrigeration elements of the present invention.

Referring now to FIGS. 14 and 15, test results are shown for the embodiment of the present invention shown in FIGS. 1 through 5 and described in the accompanying text. After the refrigerant contained in refrigeration elements 5a and 5b was frozen, the refrigeration elements 5a and 5b were inserted through reclosable opening 20 into carton 10, which contained 12 twelve-ounce cans of beverage pre-cooled to a temperature of 38. After carton 10 was reclosed, temperature sensing devices were inserted through the bottoms of three cans such that the temperature sensing elements were close to the centers of each can. Lines A and C of FIG. 14 correspond to the two cans located in different corners of carton 10, while line B corresponds to the can located in the centermost portion of carton 10. The surrounding ambient temperature during the test was approximately 90° F. Temperature readings for the three sensing devices were made in fifteen minute intervals over a four hour period. As shown in the graph of FIG. 14, the temperatures of the corner cans at the end of the test were 52° F. and 57° F., respectively, while the temperature of the centermost can was 40° F.

For purposes of comparison, a simultaneous test was conducted with an identical beverage carton 10 without the use of refrigeration elements 5. As shown in FIG. 15, the temperatures at the end of the four hour test period of two beverage cans placed in different corners of carton 10 were 61° F. and 62° F., respectively, while the temperature of the centermost can was 55° F.

From the above description of the present invention, it is shown that various advantages in the at of beverage container cooling devices are achieved. The present invention achieves these advantages in combination with a standard paperboard beverage carton. The present invention further effectively maximizes the cooling function performed by refrigeration elements inserted into the beverage carton by adapting the refrigeration elements to substantially fill all existing spaces between beverage containers within the beverage carton. While the present invention has been illustrated with reference to specific embodiments thereof, such description is not intended to limit the invention to the specific embodiments shown and described. Various modifications to the construction and application of the preferred embodiments described herein may be apparent to those skilled in the art to which the present invention pertains without departing from the spirit and scope of the present invention, which is only limited by the appended claims.

I claim:

1. A beverage container cooling device in which a plurality of beverage container are arranged in rows and columns such that each beverage container is in contacting relation with other beverage containers in adjacent rows and columns and spaces are formed between the beverage containers, comprising:

a carton for containment of a plurality of beverage containers;

said carton having a reclosable opening;

a plurality of separately removable individual refrigeration elements;

each said refrigeration element being substantially filled with a refrigerant having a freezing point of 40° F. or less;

each said refrigeration element being adapted to substantially fill the space between said beverage containers within said carton; and each said refrigeration element having a plurality of heat conducting surfaces dimensioned for surface contact only with the outer surfaces of a plurality of said beverage containers such that heat transfer between said refrigeration elements and said beverage containers occurs primarily by conduction.

2. A beverage container cooling device according to claim 1 further comprising:

a first set of separately removable individual refrigeration elements;

a second set of separately removable individual refrigeration elements;

said first set of refrigeration elements each being adapted to substantially fill the space between said beverage containers within the centermost portion of said carton;

said first set of refrigeration elements each having four heat conducting surfaces dimensioned for surface contact only with the outer surfaces of up to four beverage containers;

said second set of refrigeration elements each being adapted to substantially fill the space between aid beverage containers adjacent to the outer walls of said carton; and said second set of refrigeration elements each having two heat conducting surfaces dimensioned for surface contact with the outer surfaces of up to two said beverage containers and one surface dimensioned for surface contact with the inner surface of an outer wall of said carton.

3. A beverage container cooling device according to claim 1 wherein said plurality of heat conducting surfaces of each refrigeration element are dimensioned such that each heat conducting surface is in surface contact with about 22% of the outer surfaces of each beverage container adjacent to said refrigeration element.

4. A beverage container cooling device according to claim 2 further comprising:

said first set of refrigeration elements each having said four heat conducting surfaces dimensioned such that each heat conducting surface is in surface contact with about 22% of the outer surfaces of each beverage container adjacent to said first refrigeration element; and said second set of refrigeration elements each having said two heat conducting surfaces dimensioned such that each heat conducting surface is in surface contact with about 22% of the outer surfaces of each beverage container adjacent to said second refrigeration element.

5. A beverage container cooling device according to claim 1 wherein said heat conducting surfaces of said refrigeration elements are concave.

6. A beverage container cooling device according to claim 2 wherein said four heat conducting surfaces of said first set of refrigeration elements are concave and said two heat conducting surfaces of said second set of refrigeration elements are concave.

7. A beverage container cooling device according to claim 1 wherein said refrigerant is a water and salt compound in a gum base.

8. A beverage container cooling device in which a plurality of beverage container are arranged in rows and columns such that each beverage container is in contacting relation with other beverage containers in adjacent rows and columns and spaces are formed between the beverage containers comprising: p1 a carton for containment of a plurality of beverage containers;

a plurality of separately removable individual refrigeration elements;

each said refrigeration element being substantially filled with a refrigerant having a freezing point of 40° F. or less;

each said refrigeration element being adapted to substantially fill to the space between said beverage containers within said carton; and each said refrigeration element having a plurality of heat conducting surfaces dimensioned for surface contact with the outer surfaces of a plurality of said beverage containers such that heat transfer between said refrigeration elements and said beverage containers occurs primarily by conduction.

9. A beverage container cooling device according to claim 8 further comprising:

a first set of separately removable individual refrigeration elements;

a second set of separately removable individual refrigeration elements;

said first set of refrigeration elements each being adapted to substantially fill the space between the beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill the space between said beverage containers adjacent to the outer walls of said carton; and said second set of refrigeration elements each having two heat conducting surfaces dimensioned for surface contact with the outer surfaces of up to two said beverage containers and one surface dimensioned for surface contact with the inner surface of an outer wall of said carton.

10. A beverage container cooling device according to claim 8 wherein said plurality of heat conducting surfaces of each refrigeration element are dimensioned such that each heat conducting surface is in surface contact with about 22% of the outer surfaces of each beverage container adjacent to said refrigeration element.

11. A beverage container cooling device according to claim 9 further comprising:

said first set of refrigeration elements each having said four heat conducting surfaces dimensioned such that each heat conducting surface is in surface contact with about 22% of the outer surfaces of each beverage container adjacent to said first refrigeration element; and said second set of refrigeration elements each having said two heat conducting surfaces dimensioned such that each heat conducting surface is in surface contact with about 22% of the outer surfaces of each beverage container adjacent to said second refrigeration element.

12. A beverage container cooling device according to claim 8 wherein said heat conducting surfaces of said refrigeration elements are concave.

13. A beverage container cooling device according to claim 9 wherein said four heat conducting surfaces of said first set of refrigeration elements are concave and said two heat conducting surfaces of said second set of refrigeration elements are concave.

14. A beverage container cooling device according to claim 8 wherein said refrigerant is a water and salt compound in a gum base.

15. A refrigeration element for maintaining beverage containers within a carton at reduced temperatures for substantial time periods of at least four hours comprising:

a top surface;

a bottom surface;

a plurality of heat conducting side surfaces dimensioned for surface contact with the outer surfaces of a plurality of said beverage containers;

each said refrigeration element being substantially filled with a refrigerant having a freezing point of 40° F. or less;

each said refrigeration element being adapted to substantially fill the space between said beverage containers within said carton; and said refrigeration element transferring heat for refrigeration purposes between said beverage containers and said refrigeration element primarily by conduction.

16. A refrigeration element according to claim 15 wherein said refrigeration is a water and salt compound in a gum base.

17. A refrigeration element according to claim 15 wherein said refrigeration element has substantially the same height as said beverage containers.

18. A beverage container cooling device according to claim 15 wherein said heat conducting surfaces of said refrigeration elements are concave.

19. A beverage container cooling device according to claim 1 further comprising:

a removable panel having a plurality of individual refrigeration elements attached thereto;

said panel being dimensioned to substantially conform to the dimensions of the reclosable opening of said carton.

20. A beverage container cooling device according to claim 19 wherein said panel and said refrigeration elements are fixedly attached.

21. A beverage container cooling device according to claim 19 wherein said panel is formed of plastic.

22. A beverage container cooling device according to claim 19 wherein said panel is formed of paperboard.

23. A beverage container cooling device according to claim 1 wherein said carton is formed of paperboard.

24. A beverage container cooling device according to claim 8 wherein said carton is formed of paperboard.

25. A refrigeration element according to claim 1 wherein said refrigeration element is formed of high density polyethylene.

26. A refrigeration element according to claim 8 wherein said refrigeration element is formed of high density polyethylene.

27. A refrigeration element according to claim 15 wherein said refrigeration element is formed of high density polyethylene.

28. A refrigeration element for maintaining beverage containers within a carton at reduced temperatures for substantial time periods of at least four hours comprising:

a convex top surface;

a concave bottom surface;

a plurality of heat conducting side surfaces dimensioned for surface contact with the outer surfaces of a plurality of said beverage containers;

said refrigeration element being substantially filled with a refrigerant having a freezing point of 40° F. or less;

said refrigeration element being adapted to substantially fill a space between said beverage containers within said carton; and said refrigeration element transferring heat for refrigeration purposes between said beverage containers and said refrigeration element primarily by conduction.

29. A beverage container cooling device comprising:

a carton for containment of a plurality of beverage containers;

said carton having a reclosable opening;

a plurality of removable refrigeration elements;

each said refrigeration element being substantially filled with a refrigerant having a freezing point of 40° F. or less;

said refrigeration elements being adapted to substantially fill existing spaces between said beverage containers within said carton;

each said refrigeration element having a plurality of heat conducting surfaces dimensioned for surface contact with the outer surfaces of a plurality of said beverage containers such that heat transfer between said refrigeration elements and said beverage containers occurs primarily by conduction;

said carton including perforated openings on at least one surface thereof for insertion of said refrigeration elements therethrough; and said perforated openings being adapted to closely fit the outer dimensions of said refrigeration elements.

30. A beverage container cooling device comprising:

a carton for containment of a plurality of beverage containers;

a plurality of removable refrigeration elements;

each said refrigeration element being substantially filled with a refrigerant having a freezing point of 40° F. or less;

said refrigeration elements being adapted to substantially fill existing spaces between said beverage containers within said carton;

each said refrigeration element having a plurality of heat conducting surfaces dimensioned for surface contact with the outer surfaces of a plurality of said beverage container such that heat transfer between said refrigeration elements and said beverage containers occurs primarily by conduction;

said carton including perforated openings on at least one surface thereof for insertion of said refrigeration elements therethrough; and said perforated openings being adapted to closely fit the outer dimensions of said refrigeration elements.

31. A beverage container cooling device comprising:

a carton for containment of a plurality of beverage containers;

said carton having a reclosable opening;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said second set of refrigeration elements therethrough; and said perforated openings being adapted to closely fit the outer dimensions of said second refrigeration elements.

32. A beverage container cooling device comprising:

a carton for containment of a plurality of beverage containers;

said carton having a reclosable opening;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said first set of refrigeration elements therethrough; and said perforated openings being adapted to closely fit the outer dimensions of said first refrigeration elements.

33. A beverage container cooling device comprising:

a carton for containment of a plurality of beverage containers;

said carton having a reclosable opening;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including first perforated openings on at least one surface thereof for insertion of said first set of refrigeration elements therethrough;

said first perforated openings being adapted to closely fit the outer dimensions of said first refrigeration elements;

said carton including second perforated openings on at least one surface thereof for insertion of said second set of refrigeration elements therethrough; and said second perforated openings being adapted to closely fit the outer dimensions of said second refrigeration elements.

34. A beverage container cooling device comprising:

a carton for containment of a plurality of beverage containers;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said second set of refrigeration elements therethrough; and said perforated openings being adapted to closely fit the outer dimensions of said second refrigeration elements.

35. A beverage container cooling device comprising:

a carton for containment of a plurality of beverage containers;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said first set of refrigeration elements therethrough; and said perforated openings being adapted to closely fit the outer dimensions of said first refrigeration elements.

36. A beverage container cooling device comprising:

a carton for containment of a plurality of beverage containers;

a plurality of removable refrigeration elements;

each said refrigeration element being substantially filled with a refrigerant having a freezing point of 40° F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including first perforated openings on at least one surface thereof for insertion of said first set of refrigeration elements therethrough;

said first perforated openings being adapted to closely fit the outer dimensions of said first refrigeration elements;

said carton including second perforated openings on at least one surface thereof for insertion of said second set of refrigeration elements therethrough; and said second perforated openings being adapted to closely fit the outer dimensions of said second refrigeration elements.

37. A beverage container cooling device comprising:

a carton for containment of a plurality of beverage containers;

said carton having a reclosable opening;

a plurality of removable refrigeration elements;

each said refrigeration element being substantially filled with a refrigerant having a freezing point of 40) F. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said second set of refrigeration elements therethrough;

said perforated openings being adapted to closely fit the outer dimensions of said second refrigeration elements; and each said second refrigeration element having a slightly angled bottom surface forming a point to facilitate punching through said perforated openings.

38. A beverage container cooling device comprising:

a carton for containment of a plurality of beverage containers;

a plurality of removable refrigeration elements;

each said refrigeration element being substantially filled with a refrigerant having a freezing point of 40° C. or less;

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton;

said carton including perforated openings on at least one surface thereof for insertion of said second set of refrigeration elements therethrough;

said perforated openings being adapted to closely fit the outer dimensions of said second refrigeration elements; and each said second refrigeration element having a slightly angled bottom surface forming a point to facilitate punching through said perforated openings.

39. A refrigeration element for maintaining beverage containers within a carton at reduced temperatures for substantial time periods of at least four hours comprising:

a top surface;

a bottom surface;

two heat conducting side surfaces dimensioned for surface contact with the outer surfaces of up to two beverage containers;

a planar side surface dimensioned for surface contact with the inner surface of an outer wall of said carton;

said refrigeration element being substantially filled with a refrigerant having a freezing point of 40° F. or less;

said refrigeration element being adapted to substantially fill existing spaces between up to two said beverage containers in a parallel configuration within said carton; and said refrigeration element transferring heat for refrigeration purposes between said beverage containers and said refrigeration element primarily by conduction.

40. A beverage container cooling device according to claim 19 wherein said panel and said refrigeration elements are removably attached.

41. A beverage container cooling device comprising:

a carton for containment of a plurality of beverage containers;

a plurality of removable refrigeration elements;

each said refrigeration element being substantially filled with a refrigerant having a freezing point of 40° F. or less;

said refrigeration elements being adapted to substantially fill existing spaces between said beverage containers within said carton;

each said refrigeration element having a plurality of heat conducting surfaces dimensioned for surface contact with the outer surfaces of a plurality of said beverage containers such that heat transfer between said refrigeration elements and said beverage containers occurs primarily by conduction; and said carton including perforated openings on at least one surface thereof for insertion of said refrigeration elements therethrough.

42. A beverage container cooling device according to claim 41 wherein said carton has a reclosable opening.

43. A beverage container cooling device according to claim 42 further comprising:

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton; and said carton including perforated openings on at least one surface thereof for insertion of said second set of refrigeration elements therethrough.

44. A beverage container cooling device according to claim 42 further comprising:

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surface of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton; and said carton including perforated openings on at least one surface thereof for insertion of said first set of refrigeration elements therethrough.

45. A beverage container cooling device according to claim 44 further comprising:

said carton including first perforated openings on at least one surface thereof for insertion of said first set of refrigeration elements therethrough; and said carton including second perforated openings on at least one surface thereof for insertion of said second set of refrigeration elements therethrough.

46. A beverage container cooling device according to claim 41 further comprising:

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surfaces of up to two said beverage containers and one surface dimensioned for surface contact with the inner surface of an outer wall of said carton; and said carton including perforated openings on at least one surface thereof for insertion of said second set of refrigeration elements therethrough.

47. A beverage container cooling device according to claim 41 further comprising:

said refrigeration elements comprising a first set of refrigeration elements and a second set of refrigeration elements;

said first set of refrigeration elements each being adapted to substantially fill existing spaces between said beverage containers within the centermost portion of said carton;

said first set of refrigeration elements each having four heat conducting surfaces dimensioned for surface contact with the outer surfaces of up to four beverage containers;

said second set of refrigeration elements each being adapted to substantially fill existing spaces between said beverage containers adjacent to the outer walls of said carton;

said second set of refrigeration elements each having two heat conducting surfaces dimensioned for surface contact with the outer surface of up to two said beverage containers and one surface dimensioned for surface contact with the inner surface of an outer wall of said carton; and said carton including perforated openings on at least one surface thereof for insertion of said first set of refrigeration elements therethrough.

48. A beverage container cooling device according to claim 47 further comprising:

said carton including first perforated openings on at least one surface thereof for insertion for said first set of refrigeration elements therethrough; and said carton including second perforated openings on at least one surface thereof for insertion of said second set of refrigeration elements therethrough.

49. A beverage container cooling device according to claim 43 wherein each said second refrigeration element has a slightly angled bottom surface forming a point to facilitate punching through said perforated openings.

50. A beverage container cooling device according to claim 46 wherein each said second refrigeration element has a slightly angled bottom surface forming a point to facilitate punching through said perforated openings.

* * * * *